United States Patent [19]

Craig et al.

[11] 4,388,063

[45] Jun. 14, 1983

[54] COMBUSTION HEATING SYSTEM

[76] Inventors: Laurence B. Craig, 116 Duck Pond Rd., Glen Cove, N.Y. 11542; Alfred J. Farina, 1939 Anita Ct., Baldwin, N.Y. 11510

[21] Appl. No.: 197,571

[22] Filed: Oct. 16, 1980

[51] Int. Cl.[3] ..... F23N 5/00

[52] U.S. Cl. ..... 431/19; 431/75; 431/353; 126/91 A

[58] Field of Search ..... 431/19, 21, 43, 69, 431/77, 78, 353, 75; 126/91 A

[56] References Cited

U.S. PATENT DOCUMENTS

| | | | |
|---|---|---|---|
| 2,216,534 | 10/1940 | Kirk | 431/43 |
| 3,179,156 | 4/1965 | Weiss et al. | 431/329 |
| 3,191,659 | 6/1965 | Weiss | 431/328 |
| 3,425,675 | 2/1969 | Twine | 126/91 A |
| 3,938,939 | 2/1976 | MacAskill et al. | 431/69 |
| 4,128,387 | 12/1978 | Rayburn et al. | 431/78 |
| 4,145,180 | 3/1979 | Bendorf | 431/78 |

*Primary Examiner*—James C. Yeung
*Assistant Examiner*—Margaret A. Focarino

[57] ABSTRACT

A porous ceramic heating reactor is positioned within a tubular casing to contain the flame and the end products of combustion. A flattened portion of the casing extends substantially past the reactor to provide for further transfer of heat through the casing wall from the hot exhaust gases and to carry those exhaust gases to a safe point of exhaustion. The unit is essentially modular so that any number can be selected for an installation. The casing configuration enhances turbulent flow of the hot gaseous products of combustion. Turbulent flow increases heat transfer to and through the walls of the casing to the boilder or other area to be heated. The size and shape of the tubular casing provides an explosion proof, leak proof, efficient heat transfer device. Each reactor has a spark plug one of whose elements is a bi-metallic strip. In a multi-unit installation the spark plugs are connected in parallel across a spark generator. As the spark seeks the smallest gap, one will spark first, initiate combustion, and in response to the heat expand its gap and the spark will shift to the next smallest gap. The sequence will continue for as many reactors as are in the system. A normally open pressure responsive switch is connected to sense the difference in pressure between the fuel inlet line to the reactor and the combustion chamber within the casing. If the pressure differential is not maintained, the switch opens and shuts down the system. However, a slow blow fuse connected across the contacts of the pressure responsive switch prevents shutdown for a short 15 second time period sufficient to permit the initiation of ignition.

3 Claims, 7 Drawing Figures

COMBUSTION HEATING SYSTEM

BACKGROUND OF THE INVENTION

This invention relates to a combustion heating system and more particularly one employing a unit having a porous ceramic reactor contained within a casing.

Gas fired porous ceramic reactors for generating an intense heat have been known and used for an appreciable period of time. A radiant gas burner incorporating such is described in U.S. Pat. No. 3,191,659 issued June 29, 1965, and another is described in connection with a space heater in U.S. Pat. No. 3,179,156 issued Apr. 20, 1965. Widespread use of these ceramic reactors for the heating of an entire home or building has been limited for a number of reasons. Among the reasons are the problems of disposing of the waste products, particularly carbon monoxide and carbon dioxide, that result from the burning of the gaseous fuel. It is important that these products not be emitted in any large quantities within the room or dwelling being heated. Another requirement that has been difficult to meet is the need for a safe, gas tight system from inlet to outlet to avoid having the gas fuel as well as the products of combustion seep into the spaces or room that is being heated. Another requirement is that the gas fired system be explosion proof to an extremely high degree of reliability.

Accordingly, among the purposes of this invention is to achieve such in a fashion that provides a high degree of efficiency in the transfer of heat from the ceramic radiant burner to the area to be heated.

It is a related purpose of this invention to provide a system in which the combustion of the gas will be as nearly complete as possible to as to be fuel efficient and to minimize pollutants.

Various applications for the use of a contained reactor for heating a boiler, or the like, will call for a range of heating capacity. In smaller systems one or two of the reactor elements will be required. Accordingly, it is a purpose of this invention to provide a heating unit design which meets the above objects and is sufficiently modular in form so that any required number can be selected for a particular installation.

When a plurality of reactor elements are involved, the ignition power required may be substantial. However, if the reactor elements can be ignited in sequence, the power capacity of the ignition generator can be minimized. Accordingly, it is a further purpose of this invention to provide a technique for simply and reliably sequencing the ignition of the reactor elements in a multi-element system and to do so in a fasion that assures that combustion has been achieved in one unit before the spark is removed from that unit.

It is important that the system be shut down if or when there is a failure of combustion. Specifically, it is important that the system stop pumping fuel and that voltages be removed if either ignition is not achieved when the system is turned on or if combustion is lost after the system has been running. It is important that the safety shutdown mechanism be simple, reliable and inexpensive. Yet it is also essential that the shutdown mechanism not respond to the interim condition that exists when the system is initially turned on. Thus, it is a further purpose of this invention to provide a safety shutdown system that accepts the interim conditions which occur during the initiation of ignition yet adequately responds to comparable conditions that indicate a failure of ignition or loss of burning.

BRIEF DESCRIPTION

In brief, in one embodiment, a unitary, elongated casing is provided having an upstream cylindrical portion in which a ceramic reactor is positioned. A gaseous fuel and air mixture is supplied to the upstream end of the ceramic reactor. Downstream of the reactor, the casing is compressed to provide a substantially lesser cross-sectional area so that the flow of the hot gaseous products of combustion will be turbulent through the downstream portion of the casing. The casing terminates in an exhaust tube which vents the combustion gases to the atmosphere.

The heat generated by the combustion of the gaseous fuel in the reactor is radiated by the reactor to the casing wall as well as carried to the casing by the hot products of combustion. The hot gases which flow through the downstream portion of the casing carry heat to the casing surface, which heat transfer is enhanced by the turbulent flow of the gases. The heat is conducted through both portions of the casing surface to the water of the boiler in which this heat generation device is mounted.

A pressure differential responsive switch closes and stays closed if and only if the pressure differential between the inlet fuel and the combustion chamber is maintained. If the system either fails to ignite or if combustion stops, the switch contacts open to shutdown the system. However, a slow blow fuse across the switch contacts delays the shutdown for 15 seconds. This delay permits ignition and burning to get underway when the system is first turned on to build up the pressure differential and thus to close the pressure switch to maintain the system on as long as there is no malfunction.

Multiple units may be arranged in a system. Each unit is ignited by its individual spark plug. One element of each spark plug is a bi-metallic strip. The plugs are connected in parallel across a single spark generator. The plug with the smallest gap sparks first, the associated heating device ignited and burns, heating the spark plug elements. The bi-metallic element moves to increase the spark gap and the plug with the second smallest gap sparks. The sequence continues through as many spark plugs and associated heating elements as are used in an installation.

DESCRIPTION OF THE PREFERRED EMBODIMENTS

All of the figures relate to the same embodiment of the heat generation and transfer device 10 of this invention.

The Heat Generation and Transfer Structure

A unitary elongated casing 12 has an upstream cylindrical portion 12*c* that terminates in an outwardly extending annular flange 12*f*. The casing 12 has a downstream portion 12*d* which is fabricated by flattening the initial cylindrical copper tube stock into a highly elliptical section and then curving that elliptical section into a C-shaped portion having a maximum diametrical dimension no greater than the diameter of the upstream cylindrical portion 12*c*. This C-shaped downstream portion 12*d* terminates in a tubular end portion 12*e* having the same diameter as the portion 12*c*.

The casing 12 encloses the porous ceramic reactor 20 and thus combustion of a fuel (either gas or vapor) occurs within the casing 12. Fuel and air are supplied to the reactor 20 at the upstream end of the casing 12 and the gaseous products of combustion are exhausted from the opening at the downstream end 12*e* of the casing 12. The casing 12 is made of sheet metal such as thin wall copper tubing and serves to transfer the heat generated from the combustion of the fuel within the casing 12 to the area outside of the casing.

Figure 1:
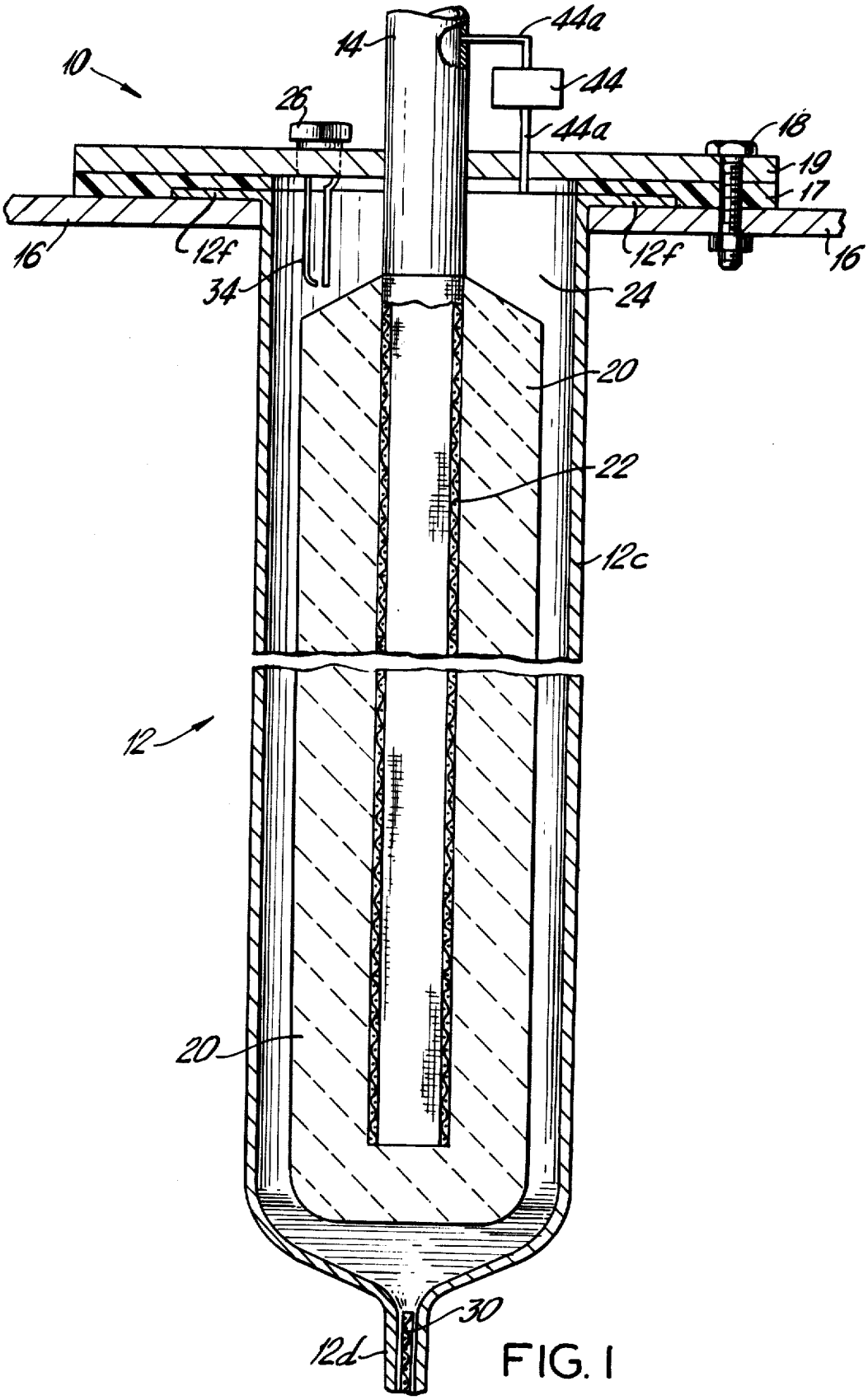
FIG. 1 is a longitudinal sectional view through the combustion portion of the heating device of this invention illustrating the ceramic reactor and the combustion chamber.
Figure 2:
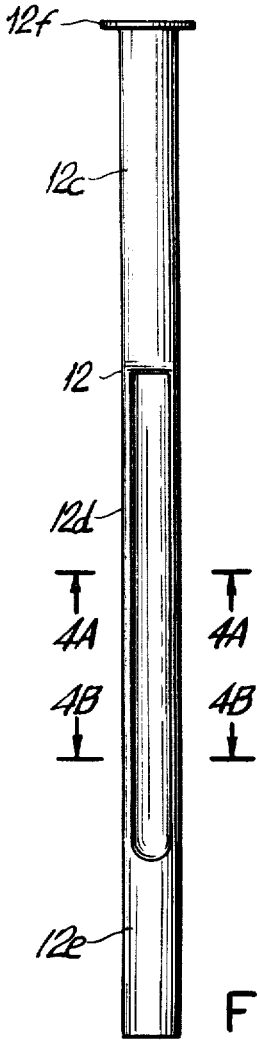
FIGS. 2 and 3 are two external views of the device of this invention. These views are taken along planes that are orthogonal to one another and illustrate the distinction between the cylindrical section 12*c* of the casing that defines the combustion chamber and the compressed casing section 12*d* which provides for turbulent flow of the hot exhaust gases.
Figure 3:
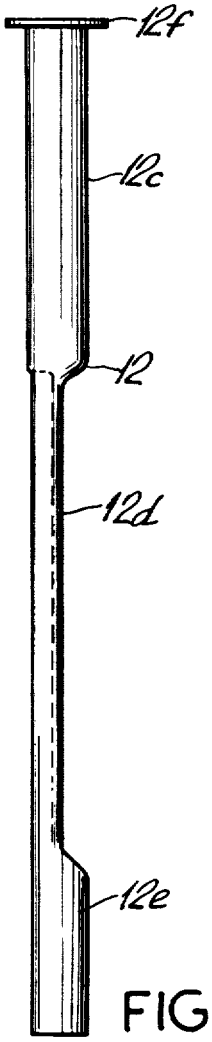
Figure 4A:
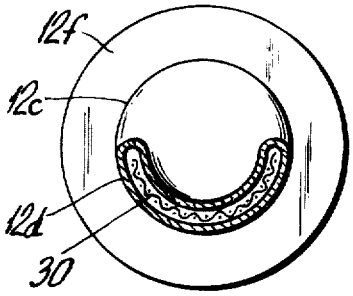
FIGS. 4A and 4B are sectional views along the planes 4A and 4B of FIG. 2 taken in the direction shown by the arrows illustrated in FIG. 2.
Figure 4B:
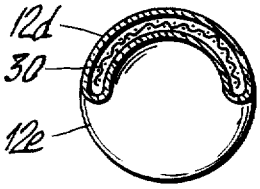

As may best been seen in FIG. 1, the casing 12 is mounted on a support plate 16. An annular recess in gasket 17 retains the flange 12*f*. Bolts 18, only one of which is shown, hold a cover member 19 to gasket 17 and plate 16. The units 10 can be mounted in any attitude. It is anticipated that one or a multiple number of individual units 10 will be mounted on the casing of a boiler. On the inboard side of the plate 16 surrounding the casing portions 12*c* and 12*d* there will normally be a chamber through which water is circulated and, as it is circulated, picks up heat from the walls 12*c*, 12*d* of the casing 12.

The inlet tube 14 feeds the fuel gas and air mixture to the center of a ceramic reactor 20. The reactor 20 may be one of a number of known types of gas-fired porous ceramic reactors for generating intense heat providing it is made to be geometrically suitable. The fuel, such as natural gas, mixed with air coming through the tube 14 passes into an interior cylindrical chamber within the ceramic reactor 20 and passes through a cylindrical screen 22 which lines that chamber and thence into the ceramic reactor 20 which is porous enough to permit the fuel gas to pass therethrough. The fuel-air mixture fills the chamber 24 within the casing 12 and is ignited by a spark from a spark plug 26. When the device 10 is turned on, a motor driven pump 43 (see FIG. 5) provides the correct fuel mixture to the inlet tube 14 and a spark plug 26 provides an electrical spark to ignite the fuel-air mixture within the chamber 24.

As is known, the ceramic reactor 20 assures a continuous even burning of the fuel along the entire surface of the reactor 20 causing the reactor 20 to incandesce thereby radiating a substantial amount of heat to the entire wall portion 12*c*. The passage of the products of combustion through the chamber 24 causes heat to be carried, by convection, to the metal wall portion 12*c* from which the heat is transferred, by conduction, to whatever medium, such as water, is circulating on the outside of the casing portion 12*c*.

The hot gas products of combustion also pass through the flattened casing portion 12*d* thereby transferring additional heat to the walls of the casing portion 12*d* and thence to whatever water, or other medium, is circulating around the casing 12. Because the passage through the casing 12*d* is restricted, the exhaust gases exhibit turbulent flow. This turbulent flow maximizes the transfer of heat from the hot gases to and through the casing sidewall. The casing portion 12*d* is preferably caused to curve so that it can be readily fitted through the opening in the plate 16 when assembling a plurality of these devices 10 in a boiler or the like. The substantially cooled products of combustion pass out of the system through an opening at the end portion 12*e* of the casing. Because of the design of this device 10, the end portion 12*e* may extend through another plate and thus can be readily vented, usually through additional tubing, to the outside thereby eliminating circulation of the end products of combustion into the home or other space being heated.

The heat generation and transfer device 10 of this invention is adapted to be employed in multiple units in an installation. The number of units of the device 10 employed will be a function of the heating capacity desired.

To enhance the turbulence of the flow through the flattened section 12*d*, a coarse screen 30 is deployed therein. The coarse screen also heats up and provides a degree of reradiation of heat as well as creating turbulence of the hot exhaust gases.

The unitary elongated casing 12 may be made without the flange 12*f* and without curving the flattened section 12*d*. These features are desirable for mounting and removal in certain cases. However, the omission of these features will not materially affect the effectiveness of this invention as an efficient heat transfer mechanism.

In one embodiment that has been tested, the casing 12 is 90 cm. long, the cylindrical portion 12*c* is 30 cm long, the C-shaped flattened portion 12*d* is 45 cm. long and the end portion 12*e* is 15 cm. long. The internal diameter of the cylindrical portion 12*c* is 5 cm. and the internal dimensions of the flattened portion 12*d* are approximately 7.5 cm along the C-shaped line and 0.3 cm thick. The coarse mesh 30 employed in the flattened portion 12*d* has a mesh opening of approximately 0.8 cm. employing a mesh wire having a 0.2 cm. diameter.

With dimensions such as the above, the size of the chamber 24 relative to the reactor 20 is such as to render the device 10 of this invention virtually explosion proof. The casing 12*c* contains the reactor in a relatively small combustion chamber 24. Yet there is enough space so that the products of combustion can readily circulate through and out of the chamber 24. A relatively small spacing between reactor 20 and wall 12*c* also means that the radiation of heat from ceramic reactor 20 to wall 12*c* is efficient. The fact that the casing 12 is unitary from flange 12*f* to end 12*e* minimizes any possibility of leakage of either fuel gas or of the products of combustion.

The operating temperature of the embodiment tested is between 925° C. and 1000° C. This temperature is sufficiently below the temperature, approximately 1100° C., where nitrogen oxide products are formed so that there is minimal $NO_x$ in the exhaust gases. Furthermore, keeping the temperature from going much greater tends to prolong the life of the reactor 20, avoids having to employ sophisticated materials to resist degradation from higher temperatures and tends to optimize the percentage of the heat radiated that is absorbed by the side wall 12c. Although it is true that a higher temperature will generate a disproportionately greater amount of heat, it is believed that this temperature range provides the optimum trade-off of heat generation versus the above mentioned characteristics.

Safety Switch Mechanism

Figure 5:
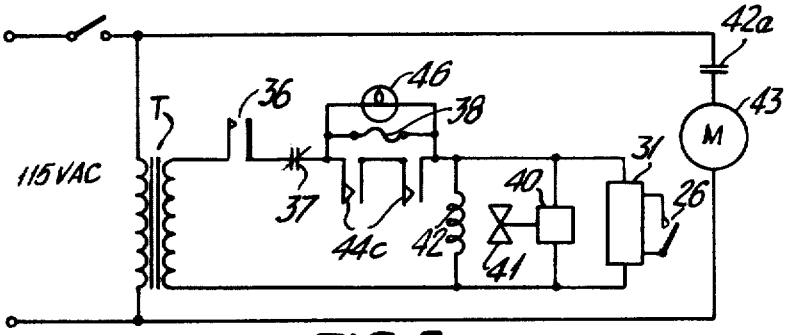
FIG. 5 is an electrical schematic illustrating a safety feature for shutting down the system in response to combustion failure.

FIG. 5 is a schematic illustration of a safety switch mechanism that is employed with the heating unit 10. This safety switch mechanism is described in connection with a boiler system employing two of the heating units 10. However the same safety switch mechanism can be employed where one unit 10 is used or where any larger number of units 10 are employed.

As is common in the industry, the electrical devices employed directly in the combustion chamber are operated on a 24 volt line. Accordingly, the 115 volt line that is normally available is transformed down by a transformer T to a 24 volt value. When a normally open room thermostat 36 closes to indicate that heat is desired, power is applied through slow blow fuse 38 to the spark generator 31 and to a solenoid 40 which actuates the gas valve 41. At the same time the relay 42 is energized to close the relay contacts 42a thereby starting the motor 43 of the pump for the fuel-air supply. The spark generator 31 applies voltage to the spark plugs 26 (see FIGS. 1 and 6).

A pressure actuated normally open switch 44 is connected by capillary tubing 44a to the interior of the fuel-air inlet 14 and to the combustion chamber 24. The contacts 44c (see FIG. 5) of each differential pressure switch 44 are electrically connected in series. A slow blow fuse 38 is connected across the series combination of contacts 44c. If combustion is properly established, the normally open switch 44 will detect a pressure differential between the pressure of the fuel-air mixture being pumped through the inlet 14 and the pressure within the combustion chamber 24. This differential pressure will cause the pressure switch 44 to close, thereby closing the contacts 44c, and shorting across the slow blow fuse 38 to prevent the fuse 38 from opening. If, however, combustion is not established or fails for a number of different reasons in any one of the heating devices 10, the associated pressure switch 44 will not close, or, if closed, will open and the slow blow fuse 38 will, because of an overload, open. The slow blow fuse 38 is selected to withstand the load for a predetermined time period of, for example, fifteen seconds.

The use of the slow blow fuse 38 across the contacts 44c of the pressure responsive switch 44 is essential in order to provide a current path for initiating the opening of the gas valve 40, the closing of the relay contacts 42c and the consequent turning on of the motor and application of voltage to the spark plugs. The slow blow fuses 38 will maintain the system on for at least ten seconds, which is sufficient time for the system to develop the pressure differentials necessary to close the pressure responsive switch 44.

The required pressure differential between the inlet 14 and the combustion chamber 24 will not be achieved (or will be diminished) if there is a failure of ignition, if the combustion reaction ceases, if there is a crack in the ceramic reactor 20 or if any one of a number of other malfunctions occurs. In any case, the malfunction will result in the associated pressure responsive switch 44 remaining open or opening and the slow blow fuse 38 consequently opening within a short time period. In this fashion, a safety arrangement is provided which will shut down the whole system if any of a number of different defects occurs. The opening of the slow blow fuse 38 removes current from the solenoid 40 causing the fuel valve to shut as well as removing current from the spark generator 31, and from the relay 42 thereby removing voltage from the system. The indicator light 46 lights up when the fuse 38 and contacts 44c are open to indicate the existance of a malfunction.

Although a pressure responsive switch 44 is the presently preferred device for sensing loss of combustion or other defect, other types of sensors could be employed. For example, a temperature sensing device, such as a thermistor, which actuates a switch and which responds to the attaining of a predetermined temperature level could be employed. The predetermined temperature level would be high enough to indicate with assurance that combustion is continuing.

Instead of the slow blow fuse 38, a delayed action resettable circuit breaker could be employed. Both have the same type of action and would perform the same function. As used herein, the term "delayed reaction fuse means" shall be understood to include a slow blow fuse, a delayed action circuit breaker or any other device that performs the same function.

In one embodiment that has been tried and tested, the pressure sensitive switch 44 employed is the differential pressure switch Model No. G 543 manufactured by the Eaton Corporation.

In this fashion a simple, sure, inexpensive technique is provided to shutdown the system if ignition is not achieved or if burning is lost. Yet this shutdown will not occur during the time it takes to initiate burning.

Spark Plug Sequencing

When two or more of the heating devices 10 are employed in a boiler system, each has to be ignited. Each spark plug 26 employed in this invention is made using a bi-metallic strip as one of the elements that define the spark gap.

Figure 6:
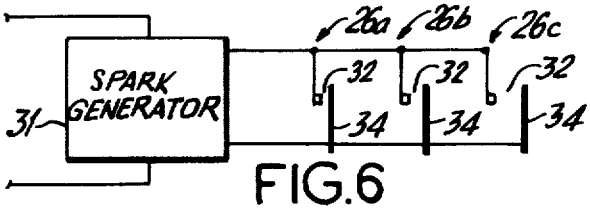
FIG. 6 is an electrical schematic illustrating a technique for sequencing the firing of a plurality of the heating devices of this invention.

FIG. 6 schematically illustrates the arrangement in which three of the heating units 10 are employed in a single boiler. The three spark plugs 26a, 26b and 26c are arranged electrically in parallel with one another and are connected across a common spark generator 31. As shown in somewhat exaggerated form in FIG. 6, the gaps 32 for each of the three spark plugs 26a, 26b and 26c differ from one another. One of the conductive elements 34 of each of these spark plugs 26a, 26b and 26c is a bi-metallic element which is designed, when it is heated, to move outwardly and increase the spark gap.

Thus, in operation, when the system is turned on, the spark generator 31 applies a voltage across the gap of each of the three spark plugs 26a, 26b and 26c. The spark plug 26a having the smallest gap will spark causing the fuel-air mixture within the associated chamber 24 to ignite. Once ignited, and the temperature in the chamber increases, the bi-metallic element 34 will bow outwardly increasing the gap at the spark plug 26a. When the gap 32 of the plug 26a exceeds that of the plug 26b, normally within two to three seconds, the spark generator will cause the spark plug 26b to spark and the spark plug 26a will cease sparking. The situation described above will then repeat in which the bi-metallic element 34 for the spark plug 26b will bow outwardly until its gap 32 is greater than that for the spark plug 26c at which point the spark plug 26c will spark thereby igniting the fuel in the chamber associated therewith.

The sequence in which the devices 10 ignite is not important and thus no particular selection or arrangement has to be made and one can rely on the normal gap variation to achieve the sequencing effect.

In this fashion, each of the three associated heating elements will be ignited in sequence yet only one spark generator need be employed. Accordingly, an economical spark generator technique is provided.

What we claim is:

1. In a heat generation and transfer device having a reactor for generating heat from the combustion of a fuel, a casing surrounding the reactor to define a combustion chamber, and an operational circuit including means for igniting a gaseous fuel fed under an initial low pressure sufficient for flowing the fuel through the reactor to the combustion chamber in which the fuel expands during combustion and exhibits an increased higher operational pressure, the safety improvement comprising:

switch contacts normally held open by spring urgency and closed in response to an overriding pressure, which when closed complete an operational circuit for the continued combustion of fuel within the chamber, a sensor responsive to said higher operating pressure of said combusted gaseous fuel within the combustion chamber to cause said normally open switch contacts to close in response thereto, and delayed reaction fuse means electrically connected across said normally open switch contacts to provide an alternate path for completion of said operational circuit, the normal operating current for the operating circuit being sufficient to cause said fuse means to open after a predetermined time, said predetermined time being greater than the time required to initiate combustion and provide said overriding pressure.

2. The safety improvement of claim 1 involving a plurality of the heat generation and transfer devices, each having a support sensor and associated pair of normally open switch contacts, wherein:

said plurality of normally open switch contact pairs are connected in electrical series as part of the operational circuit, and said fuse means is connected across the series combination of said switch contacts, whereby the opening of any one of said switch contacts will open the operational circuitry causing operational circuit current to flow through said fuse means until said fuse means opens.

3. The safety improvement of claims 1 or 2 wherein said delayed reaction fuse means is a slow blow fuse.

* * * * *